US006224496B1

(12) United States Patent
Rowland et al.

(10) Patent No.: US 6,224,496 B1
(45) **Date of Patent: *May 1, 2001**

(54) GOLF CLUB HEAD WITH REMOVABLE INSERT

(75) Inventors: Michael L. Rowland; David L. Ballard, both of Kingwood, TX (US)

(73) Assignee: The Spin Doctor, Ltd., Kingwood, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/035,661

(22) Filed: Mar. 5, 1998

(51) Int. Cl.[7] ..... A63B 53/00; A63B 53/04

(52) U.S. Cl. ..... 473/288; 473/331; 473/342; 473/324; 473/330

(58) Field of Search ..... 473/342, 330, 473/331, 288, 325, 245, 324, 350, 332, 340, 329

(56) References Cited

U.S. PATENT DOCUMENTS

| | | | |
|---|---|---|---|
| 1,094,599 | | 4/1914 | Samson . |
| 1,253,700 | * | 1/1918 | McLaughlin . |
| 1,289,553 | * | 12/1918 | Sanders . |
| 2,447,967 | | 8/1948 | Stone . |
| 2,660,436 | | 11/1953 | Grossman . |
| 2,908,502 | | 10/1959 | Bradstreet et al. . |
| 3,273,891 | | 9/1966 | Grim, Jr. . |
| 3,310,309 | | 3/1967 | Moss . |
| 3,721,447 | | 3/1973 | Louderback . |
| 3,989,861 | | 11/1976 | Rasmussen . |
| 4,422,638 | * | 12/1983 | Tucker . |
| 4,768,787 | | 9/1988 | Shira . |
| 4,792,140 | * | 12/1988 | Yamaguchi . |
| 4,832,344 | * | 5/1989 | Werner . |
| 4,884,808 | * | 12/1989 | Retzer . |
| 4,917,384 | | 4/1990 | Caiati . |
| 4,964,641 | | 10/1990 | Miesch et al. . |
| 5,029,865 | | 7/1991 | Kim . |
| 5,033,746 | | 7/1991 | Jones . |
| 5,125,655 | | 6/1992 | Crooks . |
| 5,299,807 | | 4/1994 | Hutin . |
| 5,303,922 | * | 4/1994 | Lo . |
| 5,310,185 | | 5/1994 | Viollaz et al. . |
| 5,354,059 | | 10/1994 | Stuff . |
| 5,362,047 | * | 11/1994 | Shaw . |
| 5,425,538 | | 6/1995 | Vincent et al. . |
| 5,445,386 | | 8/1995 | Marshall . |
| 5,688,190 | | 11/1997 | Rowland et al. . |
| 5,690,561 | | 11/1997 | Rowland et al. . |
| 5,718,644 | * | 2/1998 | Donofrio . |
| 5,921,871 | * | 7/1999 | Fisher . |

FOREIGN PATENT DOCUMENTS

| | | |
|---|---|---|
| 268181 | 6/1966 | (AU) . |

* cited by examiner

*Primary Examiner*—Sebastiano Passaniti
(74) *Attorney, Agent, or Firm*—Fulbright & Jaworski L.L.P.

(57) ABSTRACT

A golf club for imparting a desired spin to a golf ball. The golf club includes a club head having a cavity formed in its club face for securing a removable insert. The insert includes a striking face with a preferred frictional surface for imparting spin to a golf ball.

20 Claims, 4 Drawing Sheets

FIG. 1
(PRIOR ART)
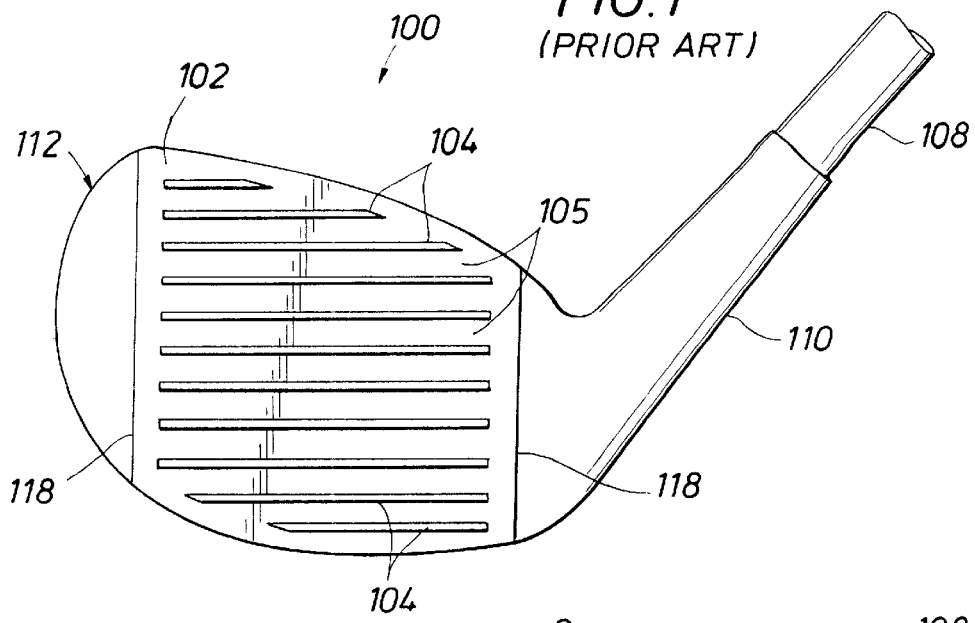
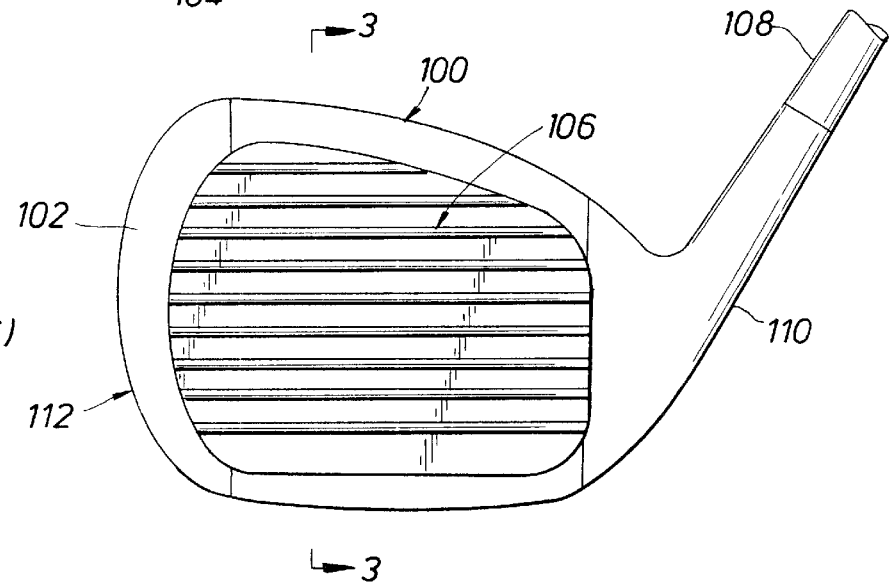
FIG. 2
(PRIOR ART)
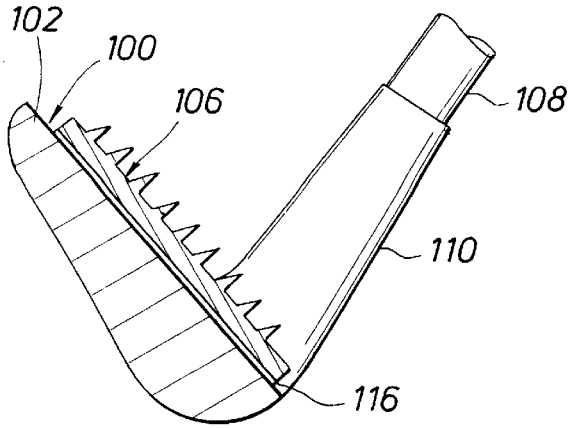
FIG. 3
(PRIOR ART)

FIG. 9
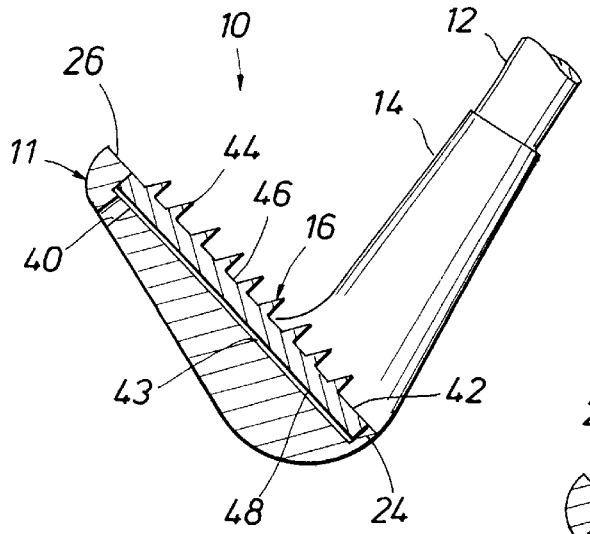
FIG. 10
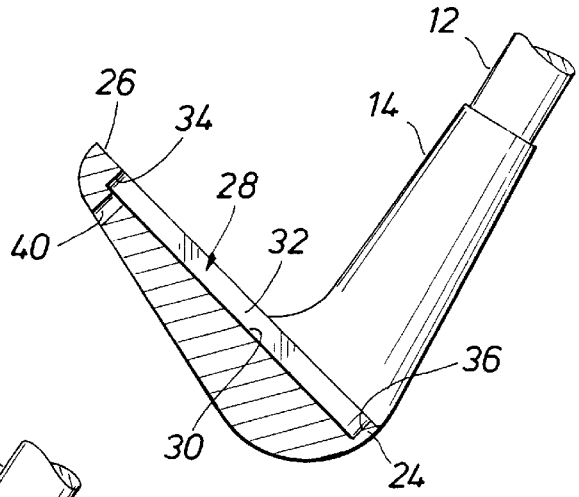
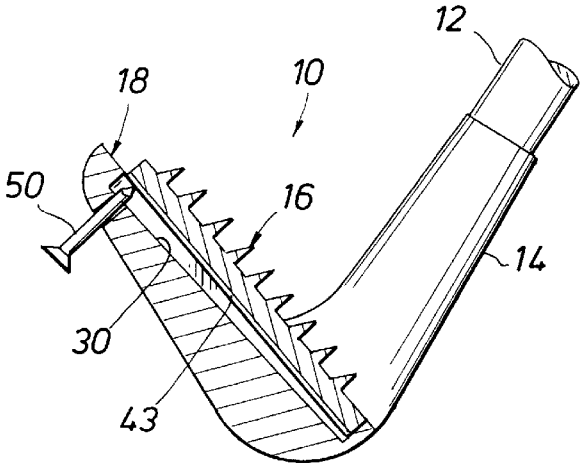
FIG. 11
FIG. 13
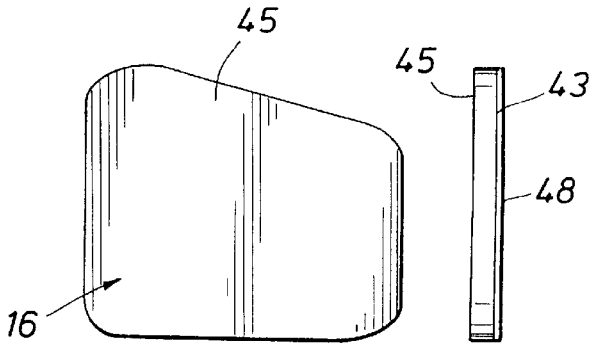
FIG. 12

GOLF CLUB HEAD WITH REMOVABLE INSERT

CROSS-REFERENCE TO RELATED APPLICATIONS

Not applicable.

STATEMENT REGARDING FEDERALLY SPONSORED RESEARCH

Not applicable.

BACKGROUND OF THE INVENTION

1. Field of the Invention

The present invention relates in general to golf clubs. In particular, the present invention relates to a golf club having a club head with cavity for securing a removable insert which imparts spin to a golf ball.

2. Description of the Related Art

Most golf clubs, often referred to as irons and woods, have a substantially planar club face surface for striking a golf ball. Typically, this club face contains a frictional element or surface roughness that imparts a rotational spin to the golf ball upon contact. As known by golfers the world over, excessive spin of the golf ball is not desirable on a drive since it may cause a slice or a hook. However, spin of the golf ball, preferably backspin, is desirable on shorter shots to control the ball's flight trajectory and to minimize the ball's rolling distance after the ball lands on the green.

Typically, most golf clubs impart some form of spin. Even if the club face hits the ball flat, the horizontal and vertical grooves or other face irregularities on the striking face on the driver or woods may still impart a slight spin. Furthermore, those clubs with more loft such as the number 7, 8, 9 clubs and the wedges are intended to impart more backspin and increase the trajectory height of a ball in an effort to minimize the ball's rolling distance after it lands on the green. Again, to do this such clubs typically include horizontal grooves within the club face. Additionally, a grit containing hard particles or a coating of plastic adhesive may be applied to the club face to provide greater friction between the ball and the club face. Thus, a conventional golf club, particularly one for shorter shots, includes some combination of horizontal grooves and frictional finishes for imparting backspin to a golf ball.

Several disadvantages exist with the conventional golf club's grooves and frictional finishes. For example, the frictional finish's useful life may be relatively short. Once the coating wears off, the grooves provide the only practical means of introducing backspin. As a result, a golfer must periodically purchase a new club to maintain the proper frictional element on the club face. For most golfers, the grooves alone are insufficient for achieving the desired backspin.

Another disadvantage is that the frictional element of a new conventional golf club may be insufficient for the novice to obtain a desirable backspin. Most new golf clubs contain a standard degree of surface roughness. The standard roughness usually complies with the golf professionals' governing body, the United States Golf Association ("USGA"). The USGA's club roughness standard serves the useful purpose of assuring that all golfers participating in golf tournaments use similar type clubs. The USGA standards, however, are not particularly useful for the weekend golf warrior facing an island green with a conventional pitching wedge. As a result of conventional golf clubs complying with the USGA standard, many golfers need greater surface roughness on their club faces then presently available on new golf clubs.

Similarly, because a conventional golf club's surface roughness is standardized, it is difficult for one club surface to sufficiently accommodate all playing conditions and all golfers. For example, on a day when the greens are hard and dry, a golfer will need to put more backspin on the ball to make it stick on the green. Under such conditions, a golfer desires a club face surface with more roughness so the club imparts as much backspin as possible to the ball. In contrast, on a wet or damp day when the greens are soft and slow, a golfer will need less backspin and thus will need a less rough club face. Although a professional golfer is adept at using a single roughness club under varying course conditions, most golfers would prefer to have club faces with varying degrees of surface roughness to achieve a desired backspin under all conditions. Thus, a golfer must purchase several clubs, each for use under a different condition.

Prior patents have realized the advantages of greater surface roughness on the club face surface by adhering carbides and other hard particles to the striking surface of golf clubs. For example, in U.S. Pat. No. 4,917,384 to Caiati there is a disclosure of adhering diamond particles directly to the club face of a smooth driver face, that is, one without grooves. However, the Caiati golf club, like a conventional golf club, loses its surface roughness over time. Moreover, because the Caiati club face does not contain grooves, but rather is smooth prior to adhering particles, it is of little use to the golfer when the particles wear off. The golfer must either purchase a new golf club or adhere new diamond particles. Additionally, because the particles are permanently adhered to the club face, the golfer may need to purchase several clubs of differing roughness to achieve a desired backspin. See also Australian Patent Specification No. 268181.

Similarly, U.S. Pat. No. 4,768,787 to Shira discloses embedding hard particles into the golf club face. Although embedding particles has the advantage of longer roughness life then adhering particles to the golf club face, it still suffers from the disadvantage of requiring the golfer to purchase several different clubs of varying roughness.

Similarly, U.S. Pat. Nos. 5,688,190 and 5,690,561 disclose removable adhesive-backed onserts for placement on the existing face of the conventional club for additional backspin.

However, the need exists for a simple and effective way of providing additional flexibility to an existing set of golf clubs enabling the user to customize the clubs to their particular needs based on skill of the player and course conditions.

SUMMARY OF THE INVENTION

The present invention provides a golf club for imparting a desired spin to a golf ball. The present invention includes a club head having a cavity formed in its club face for securing a removable insert. The insert includes a striking face with a preferred frictional surface for imparting spin to a golf ball. Depending upon the circumstances, the frictional surface of the insert may serve to minimize rotation for the woods and longer irons while maximizing backspin for the shorter irons and wedges.

When the frictional surface of the insert no longer provides the desired amount of golf ball rotation, the insert is easily and conveniently removed from the club head and replaced with another insert. Because of the cavity on the club face, the club head of the present invention differs from the substantially planar, grooved club face of conventional golf clubs.

This description is intended as a summary only, with the preferred embodiment to be described in detail and the patent claims to represent the scope of the patent coverage.

BRIEF DESCRIPTION OF THE DRAWINGS

A better understanding of the present invention can be obtained when the following detailed description of the preferred embodiment is considered in conjunction with the following drawings, in which:

FIG. 1 is a front view of a prior art golf club head;

FIG. 2 is a front view of a prior art golf club head with an onsert;

FIG. 3 is a cross-sectional view of the golf club head of FIG. 2 taken along lines 3—3 in FIG. 2;

FIG. 9 is a cross-sectional view of the present invention taken along lines 9—9 in FIG. 4;

FIG. 10 is a cross-sectional view of the club head of the present invention taken along lines 10—10 in FIG. 6;

FIG. 11 is a cross-sectional view of the present invention with the insert partially removed from the club head;

FIG. 12 is a front view of an alternative embodiment of the insert of the present invention;

FIG. 13 is a side view of the alternative embodiment of the insert of FIG. 12;

DETAILED DESCRIPTION OF THE INVENTION

Figure 4:
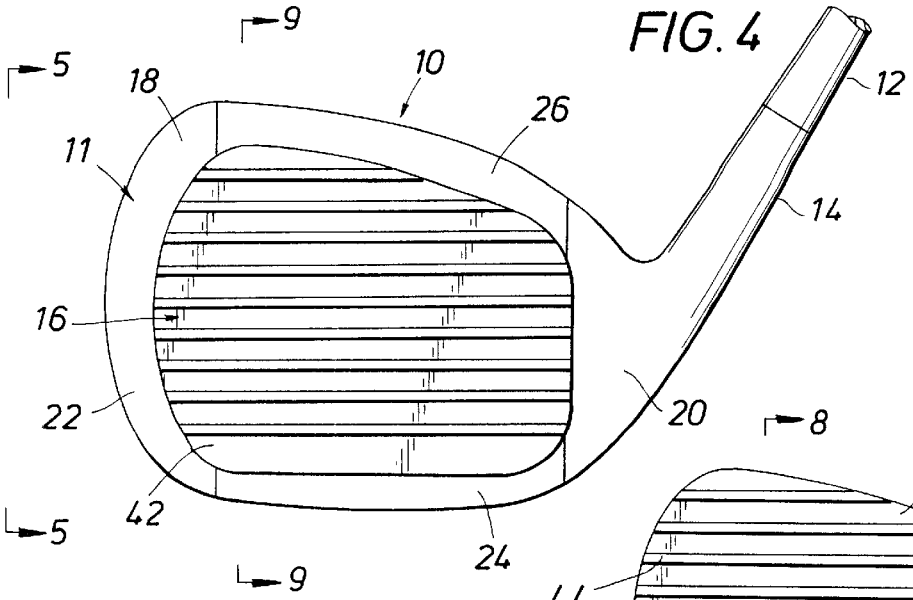
FIG. 4 is a front view of the present invention.

Referring to the drawings, and in particular to FIG. 1, a prior art golf club or conventional golf club 100 is represented by an iron with a substantially planar club face 102. The golf club 100, whether an iron or a wood, typically includes a club head 112 and a shank 110 connected to an elongated shaft 108. The club face 102 of the head 112 is generally planar and polygonal shaped, as defined by the vertical lines 118 and their intersection with the perimeter of the club head 112. In general, the club face 102 includes horizontal grooves 104 which are co-extensive with the width of the club face 102 and vertically spaced throughout the medial portion of the club face 102. Often a surface roughness or grit 105 is applied to the face 102 of the club head 112. In general, the grooves 104 and the grit 105 work together to impart backspin to a golf ball. For most recreational golfers, however, the combination of grooves 104 and grit 105 are insufficient for achieving the desired backspin.

Referring to FIGS. 2 and 3, the prior art golf club 100 is shown with a removable pad or onsert 106 attached to the face 102 of club head 112. See U.S. Pat. Nos. 5,688,190 and 5,690,561. The onsert 106 is applied to the club face 102 with an adhesive coating 116. The onsert 106 can be removed from the club face 102 by prying the onsert 106 from the club face 102. The club face 102 with the attached onsert 106 provides significantly greater backspin to a struck golf ball then the groove and grit combination of the conventional golf club 100.

Figure 5:
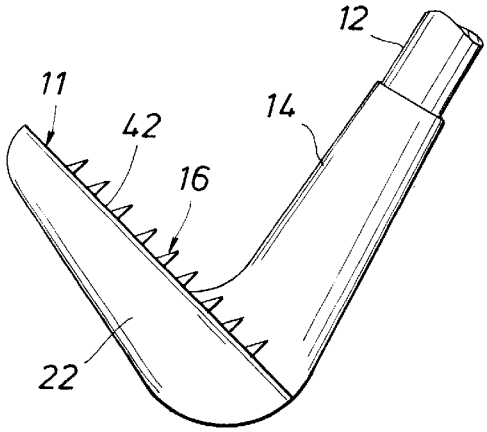
FIG. 5 is a side view of the present invention taken along lines 5—5 in FIG. 4.

Referring now to FIGS. 4 and 5, a front view and a side view, respectively, show a golf club 10 of the present invention. The golf club 10 includes a removable insert 16 temporarily secured within a club head 11. As discussed below, the insert 16 provides varying degrees of surface roughness to impart spin to a golf ball. A hosel 14 of the club head 11 connects a shaft 12 to the club head 11 to form the golf club 10. By comparing the present invention 10 of FIG. 5 with the prior art club 100 and the attached onsert 116 of FIG. 3, one can appreciate that the insert 16 does not protrude as much from the club head 11 as in the prior art.

Figure 6:
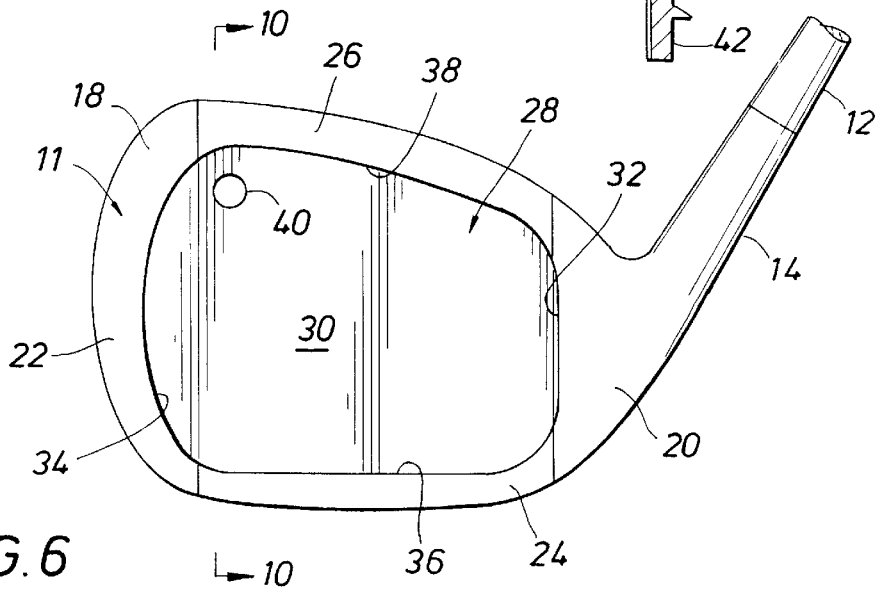
FIG. 6 is a front view of a club head of the present invention.

As shown in FIGS. 6 and 10, the club head 11 includes a cavity 28 formed by a toe edge 34, a heel edge 32, a top edge 38, and a bottom edge 36. The cavity 28 also includes a support surface or a recessed striking surface 30. In operation, the insert 16 is placed within the cavity 28 and back face 43 (FIG. 8) of insert 16 rests upon the recessed striking surface 30.

By contrast to the prior art club face 102 (FIG. 1), the club face 18 of the club head 11 does not include ridges 104 or grit 105. The recessed striking surface 30 is a smooth planar surface which is of little use to the golfer without the removable insert 16 in place. As can be appreciated, the cavity 28 of the club head 11 may be created using a mold or a cast. Alternatively, the cavity 28 could be formed by taking a conventional golf club head 112 and milling out the face 102 to the desired cavity depth. The milling process would remove the grooves 104 and the grit 105 and allow for the placement of the insert 16 into the cavity 28.

Figure 7:
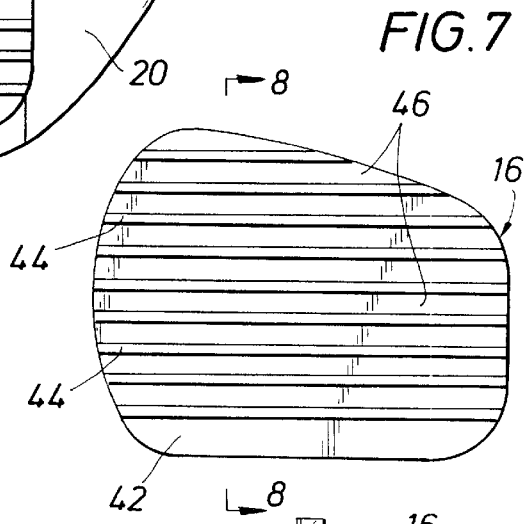
FIG. 7 is a front view of an insert of the present invention.
Figure 8:
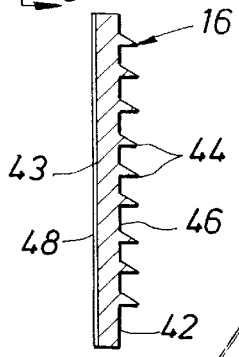
FIG. 8 is a cross-sectional view of the insert of the present invention taken along lines 8—8 in FIG. 7.

Referring to FIGS. 5, 7, and 8, the insert 16 includes a striking face 42 for imparting backspin to the golf ball. In the preferred embodiment, the striking face 42 of the insert 16 includes a plurality of spaced ridges 44 projecting from a body 46. The ridges 44 are continuous in length and are shown extending horizontally and spaced vertically from each other. Horizontally as used here means the ridges transverse the club face 18 in the same general orientation or direction as the grooves 104 of the prior art golf club face 102. Preferably, the ridges 44 and the body 46 are integrally formed using a plastic material and a molding operation. As can be appreciated, however, the striking face 42 of the insert 16 could be formed from materials other than plastic such as steel or aluminum. Preferably, the striking face 42 of the insert 16 does not mar the golf ball when imparting spin.

Alternatively, as shown in FIGS. 12 and 13, a smooth textured insert 16 can be used on a driver or wood or a lower numbered iron to reduce ball spin. The smooth surface 45 eliminates the friction normally found on the face of the drivers or long irons and thus tends to eliminate or minimize spin.

The insert 16 can be made of varying roughness. Each individual insert of varying roughness will provide a different degree of backspin to accommodate fairway and green conditions, as well as varying golfer ability. In practice, a set of inserts can be carried in a golf bag and the golfer can select and apply a particular insert roughness depending upon the shot he is facing and the desired backspin. Additionally, because the inserts can be readily applied and removed from the club face cavity, a golfer will not need to purchase additional expensive clubs to obtain the same frictional element that the inserts provide. As can be appreciated, the rougher the insert, the greater the backspin applied to the golf ball. On long approach shots to the green (typically 50 yards or more), however, a rough insert may cause undesirable scuffing of the ball. Under such conditions, a golfer may use a rubberized nonskid insert which imparts sufficient backspin for long approach shots but does not cause scuffing of the ball. Additionally, the inserts may be made of different materials such as titanium, tungsten, copper, brass, or other materials of varying stiffness. By changing the type of materials, the impact force may be modified, as well as the corresponding trajectory and the amount of spin.

As shown in FIG. 9, the insert is secured within the cavity 28 of the golf club head 11. The periphery of the insert 16 abuts the various walls of the cavity 28. The back face 43 of the insert 16 rests against the recessed striking surface 30 of the cavity 28. As can be appreciated, the insert 16 can be temporarily affixed within the cavity 28 by adhering the backside 43 of the insert 16 to the recessed striking face 30. Preferably, the adhesive coating 48 includes a double-sided tape which adheres to the back face 43 of the insert 16 and the recessed striking face 30 of the club head 11. Alternatively, the adhesive coating 48 can include a rubber or an acrylic-based bonding agent or any other suitable bonding agent that provides a temporary bond between the recessed striking surface 30 and the insert 16.

Figure 14:
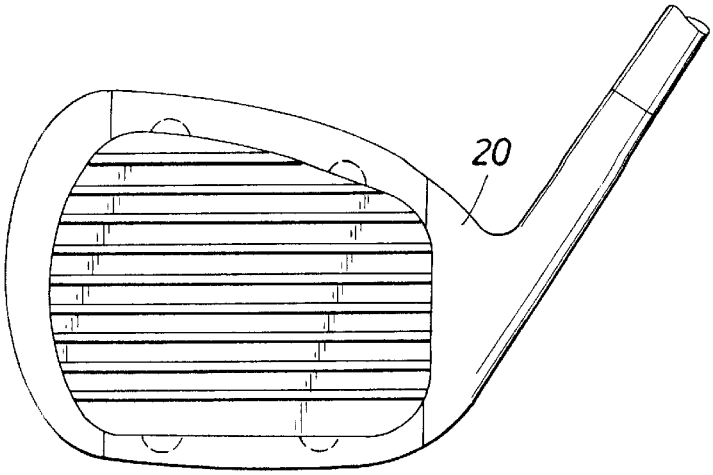
FIG. 14 is a front view of another alternative embodiment of the present invention.
Figure 16:
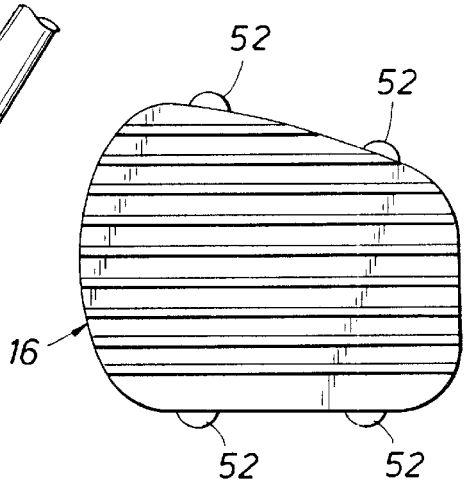
FIG. 16 is a front view of the alternative embodiment of the insert shown in FIG. 14.
Figure 15:
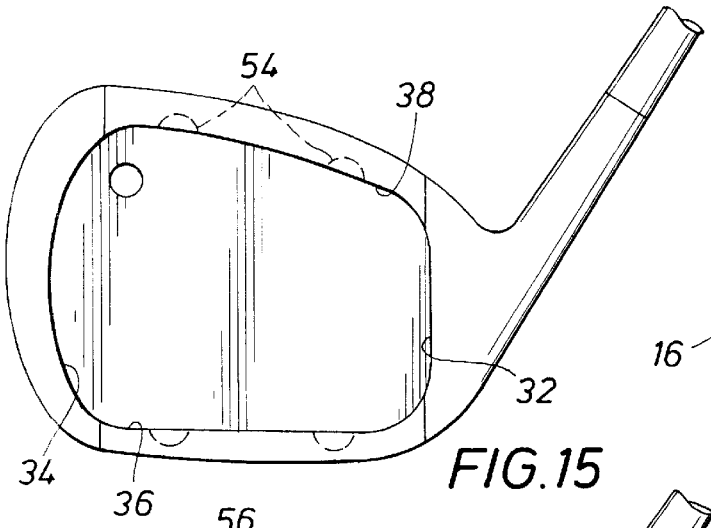
FIG. 15 is a front view of the alternative embodiment of the club head shown in FIG. 14.

Alternatively, as shown in FIGS. 14 through 16, the insert 46 can be secured within the cavity 28 by mechanical means, such a snap or press fit to position the insert 16 in place. The insert 16 may include a tab 52 for insertion into a notch 54 cut into any of the cavity edges. As shown in FIG. 15, notches 54 have been cut into top edge 38 and bottom edge 15. The tabs 52 of insert 16 can be inserted into the notches 54 to temporarily secure the insert 16 into the cavity 28.

Figure 17:
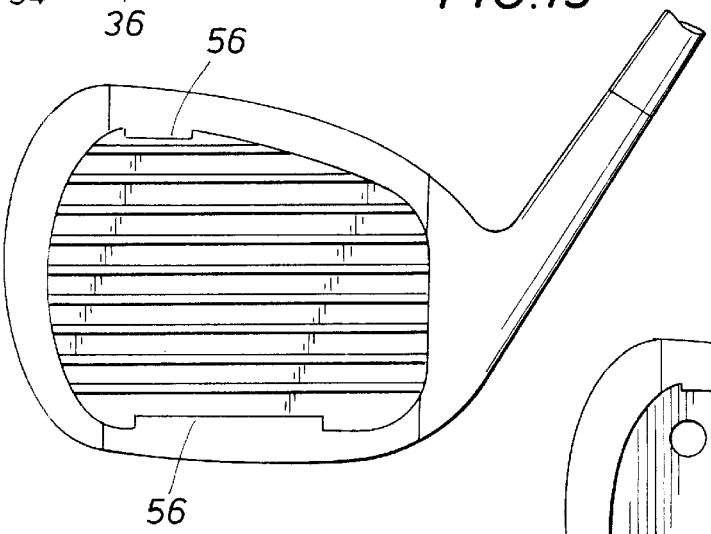
FIG. 17 is a front view of yet another alternative embodiment of the present invention.
Figure 18:
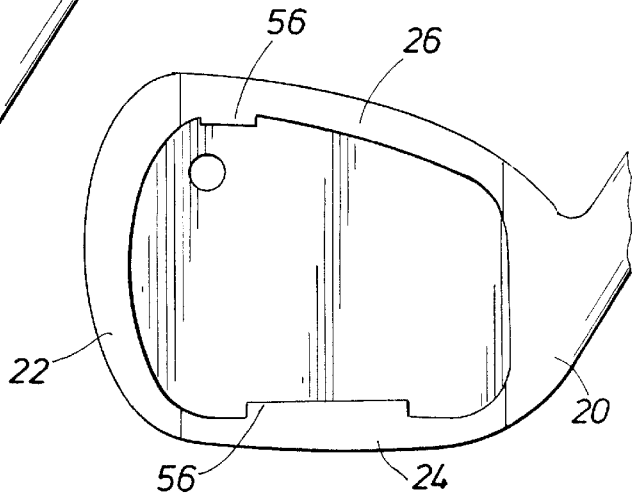
FIG. 18 is a front view of the alternative embodiment of the club head shown in FIG. 17.

Alternatively, as shown in FIGS. 17 and 18, the walls of the cavity 28 could include a flange 56 for holding the insert 16 in place. In this case, the insert 16 would snap into the cavity 28 and the flange 56 would hold the insert 16 against the recessed striking surface 30. As can be appreciated, securing of the insert 16 into the cavity 28 may utilize any combination of the preferred embodiment and the alternative embodiments, and additional ways of securing an insert within a club head will be apparent to one skilled in the art in view of this disclosure.

As shown in FIG. 11, the insert 16 is readily removed from the club head 11 by pushing a golf tee 50 or similar implement, such as a golf pencil, through an aperture 40 in the recessed striking surface 30. The golf tee 50 is pushed through aperture 40 and into contact with the back face 43 of the insert 16. Sufficient pressure applied to the tee 50 will eject the insert 16 from the cavity 28.

The foregoing disclosure and description of the invention are illustrative and explanatory thereof, and various changes in the size, shape, and materials may be made without departing from the spirit of the invention.

What is claimed is:

1. A golf club head comprising:

a club face having a cavity with a recessed striking surface;

an interchangeable insert temporarily secured within said cavity, said insert including a striking face and a back face, said back face resting upon and removably secured to said recessed striking surface so that said club face and said striking face are substantially flush; and a passageway extending through said club head and into said recessed striking surface for receiving an object to disengage at least part of said insert from said recessed striking surface for enabling the golfer to remove the insert and install another, said interchangeable insert being selected from a set of inserts wherein each insert is sufficiently different to provide a different degree of backspin to accommodate fairway and green conditions as a golfer approaches the green, as well as varying golfer ability.

2. The golf club head of claim 1, further comprising means for temporarily securing said removable insert onto said recessed striking surface.

3. The golf club head of claim 2, wherein said securing means comprises an adhesive coating on said back face.

4. The golf club head of claim 3, wherein said adhesive coating includes double-sided tape.

5. The golf club head of claim 3, wherein said adhesive coating includes a rubber based bonding agent.

6. The golf club head of claim 3, wherein said adhesive coating includes an acrylic based bonding agent.

7. The golf club head of claim 1, wherein said cavity includes at least one wall portion having a tab for temporarily securing said removable insert against said recessed striking surface.

8. The golf club head of claim 1, further comprising:

said cavity including at least one wall portion;

a notch within said wall portion;

a tab on said insert, wherein said tab inserts into said notch for temporarily securing said removable insert against said recessed striking surface.

9. The golf club head of claim 1, wherein said striking face of said insert includes a plurality of continuous ridges extending generally horizontally and spaced vertically from each other, the continuous horizontal extent of said ridges corresponding generally to the width of the insert.

10. The golf club head of claim 1, wherein said recessed striking surface includes an aperture for receipt of an implement for removing said insert from said cavity.

11. A golf club comprising:

a shaft;

a golf club head connected to one end of said shaft, said club head including a club face having a cavity with a recessed striking surface and having a passageway extending through said club head and into said recessed string surface; and an interchangeable insert temporarily secured within said cavity, said insert including a striking face and a back face, said back face resting upon and removably secured to said recessed striking surface so that said club face and said striking face are substantially flush, said interchangeable insert being selected from a set of inserts wherein each insert is sufficiently different to provide a different degree of backspin to accommodate fairway and green conditions as a golfer approaches the green, as well as varying golfer ability, wherein an object may be inserted through said passageway for enabling the golfer to disengage at least a part of said insert from said recessed striking surface and permitting the golfer to remove the insert and install another.

12. The golf club of claim 11, further comprising an adhesive coating on said back face for temporarily adhering said insert to said recessed striking surface.

13. The golf club of claim 12, wherein said adhesive coating includes double-sided tape.

14. The golf club of claim 11, wherein said striking face of said insert includes a plurality of continuous ridges extending generally horizontally and spaced vertically from each other, the continuous horizontal extent of said ridges corresponding generally to the width of the insert.

15. The golf club of claim 11, wherein said recessed striking surface includes an aperture for receipt of an implement for removing said insert from said cavity.

16. A golf club comprising:

a shaft;

a golf club head connected to one end of said shaft, said club head including a club face having a cavity with a recessed striking surface and a passageway extending through said club head into said recessed striking surface;

an interchangeable insert temporarily secured within said cavity, said insert including a striking face and a back face, said back face resting upon and removably secured to said recessed striking surface so that said club face and said striking face are substantially flush; and means for temporarily securing said insert onto said recessed striking surface, said interchangeable insert being selected from a set of inserts wherein each insert is sufficiently different to provide a different degree of backspin to accommodate fairway and green conditions as a golfer approaches the green, as well as varying golfer ability, and being adapted for easy removal by the golfer on the fairway by inserting an object through said passageway for lifting at least a part of said insert from said recessed striking surface for enabling the golfer to remove the insert and install another.

17. The golf cub head of claim 16, wherein said securing means comprises an adhesive coating on said back face.

18. A golf club head comprising:

a club face having a cavity with a recessed striking surface and a passageway extending through said club head into said recessed striking surface;

an interchangeable insert temporarily secured within said cavity, said insert including a striking face and a back face, said back face resting upon and removably secured to said recessed striking surface so that said club face and said striking face are substantially flush; and means for temporarily securing said insert onto said recessed striking surface, said interchangeable insert being selected from a set of inserts wherein each insert is sufficiently different to provide a different degree of backspin to accommodate fairway and green conditions as a golfer approaches the green, as well as varying golfer ability, and being adapted for easy removal by the golfer on the fairway by inserting an object through said passageway for lifting at least a part of said insert from said recessed striking surface for enabling the golfer to remove the insert and install another.

19. A device for use on a golf club head including a club face having a cavity with a recessed striking surface and a passageway extending through said club head into the recessed striking surface, said device comprising:

an interchangeable insert temporarily secured within said cavity, said insert including a striking face and a back face, said back face for resting upon and for removably secured to said recessed striking surface so that said club face and said striking face are substantially flush; and means for temporarily securing said insert onto said recessed striking surface, said interchangeable insert being selected from a set of inserts wherein each insert is sufficiently different to provide a different degree of backspin to accommodate fairway and green conditions as a golfer approaches the green, as well as varying golfer ability, and being adapted for easy removal by the golfer by inserting an object through said passageway for lifting at least a part of said insert from said recessed striking surface for enabling the golfer to remove the insert and install another.

20. The device according to claim 19 wherein said securing means comprises an adhesive coating on said back face.

* * * * *